United States Patent [19]

Coffman et al.

[11] 4,415,459

[45] Nov. 15, 1983

[54] WASTE DISPOSAL SYSTEMS AND METHODS

[76] Inventors: Moody L. Coffman, 1832 NW. 17th St., Oklahoma City, Okla. 73106; Lawrence R. Bradshaw, Jr., P.O. Box 14231, Oklahoma City, Okla. 73113

[21] Appl. No.: 271,818

[22] Filed: Jun. 8, 1981

[51] Int. Cl.[3] ..... G21F 9/22

[52] U.S. Cl. ..... 210/747; 210/96.1; 210/170; 252/633

[58] Field of Search ..... 210/600, 609, 747, 901, 210/170, 542, 96.1; 252/628, 631, 633; 250/506; 376/272; 405/128, 129

[56] References Cited

U.S. PATENT DOCUMENTS

| | | | |
|---|---|---|---|
| 3,325,008 | 6/1967 | Lancy | 210/747 |
| 3,835,652 | 9/1974 | Hignite | 405/129 |
| 3,847,808 | 11/1974 | Spohr | 210/747 |
| 3,935,467 | 1/1976 | Gablin | 252/626 |
| 3,940,628 | 2/1976 | Stock et al. | 252/628 |
| 4,177,386 | 12/1979 | Wachter et al. | 252/633 |
| 4,276,164 | 6/1981 | Martone et al. | 210/170 |

FOREIGN PATENT DOCUMENTS

| | | | |
|---|---|---|---|
| 2843785 | 4/1979 | Fed. Rep. of Germany | 71/9 |

*Primary Examiner*—Peter A. Hruskoci

*Attorney, Agent, or Firm*—Laney, Dougherty, Hessin & Beavers

[57] ABSTRACT

Systems and methods for the disposal of industrial and municipal wastes which include placing the wastes in confining containers at a prepared, permanent storage location for potential subsequent re-utilization by industry. The system employed includes a disposal site having a liquid impermeable supporting base surrounded by a peripheral dike with a geometrically indexing support structure built on and supported by the base. The geometrically indexing support structure includes a plurality of selectively arrayed surfaces which are collectively positioned to receive and cradle a plurality of waste containers. The waste containers are selected from five different types of containers, each of which types has a geometric configuration such that the containers may be stacked in contiguous fashion with sides abutting so as to leave no space within a vertically and horizontally stacked array of the containers. The system further includes a ramp or lifting apparatus adjacent a geometrically indexing support structure for vertically tiering the described containers, and also preferably includes at least one waste utilizing plant adjacent the peripheral dike. A waste-treating substation is positioned adjacent the dike at a location where an accessway crosses the dike to the area within the dike where the waste is to be stored.

45 Claims, 7 Drawing Figures

WASTE DISPOSAL SYSTEMS AND METHODS

BACKGROUND OF THE INVENTION

1. Field of the Invention

This invention relates to the general area of concern and technology known as waste disposal systems which minimize environmental pollution, and more particularly, to systems for disposing of large volumes of industrial and municipal waste materials in a way such that minimal environmental pollution occurs over extended periods of time, yet such wastes are retained in an accessible condition for potential usage in present or future industrial or commercial processes.

2. Brief Description of the Prior Art

In the United States, concerns have mounted rapidly in recent years over the ecological consequences of disposal methods employed by municipalities and industries in disposing of industrial by-products having either no apparent utility, or having a present utility such that disposal is generally more economic than utilization. Governmental agencies as well as private groups concerned with ecological balance and environmental pollution have brought legislative and judicial sanctions to bear upon many producers of waste which have required the investment of substantial sums, both in research and development for the purpose of investigating new and improved waste disposal methods, and in the installation and utilization of disposal systems which satisfy the much more stringent requirements and limitations which have now been imposed on entities which generate and are responsible for the production of such wastes.

To perhaps a lesser extent, the concerns for safe and ecologically feasible waste disposal have also been manifested in other countries throughout the world.

For the most part, waste disposal systems for the accommodation and satisfactory disposition of industrial and municipal waste, as they have been conceived and implemented to the present time, are still ultimately concerned with non-utilitarian disposition of such materials—that is, placing them in an isolated and contained context, without any further expectation of any useful consumption of these materials bearing upon the design of such disposal facilities. The disposal facilities which are in use range from sanitary landfills, to dumping grounds where no particular restrictions or limitations upon the debris and refuse dumped are imposed, to incineration with attendant restrictions on the tendency to atmospheric pollution, to burial at sea with unknown consequences over extended periods of time with respect to the marine fauna and flora affected. Chemical treatment is also used in some instances to undertake to detoxify or neutralize toxic and otherwise deleterious chemicals prevalent in certain waste materials, with the attendant expense of such chemical treatment representing no economic credit to the disposing concern, but being carried out primarily to meet sanitation and ecological requirements. Particularly perplexing to industries which develop radioactive waste materials in the course of their operation have been the problems attendant upon the safe, long-term disposition of such wastes from which radioactive emanations continue to originate over a period of many years.

BRIEF DESCRIPTION OF THE PRESENT INVENTION

The present invention provides novel systems and methods for the disposal of industrial and municipal wastes, which systems and methods are unique in the sense that the waste materials, normally constituting residues having no present utility and/or considered hazardous or undesirable materials, are retained in a safe, accessible location for future industrial usage, and in a way which permits such waste materials to be safely and somewhat aesthetically stored.

Broadly described, the systems provided in accordance with the present invention include a plurality of waste containers which are geometrically shaped to facilitate stacking or tiering in a way such that each of the several sides of each container, when surrounded by other containers, are flatly contacted or abutted by corresponding sides of a surrounding container, and there is no space or void left between contiguous containers. Five geometric solids, the simplest of which is the cube, are known to use to lend themselves to this type of stacking or configuration. Two forms which are preferred are the rhombic dodecahedron and a truncated octahedron. These forms are particularly desirable since they meet the basic criteria of permitting the containers to be contiguously abutted without voids or spaces between adjacent sides, and in addition, relatively large volumes of waste material, approaching more nearly the sphere in volumetric capacity than such other forms which are satisfactory for use in the invention, such as the cube. The preferred forms are also of relatively high strength. The waste containers described are filled with various industrial wastes at the sites of generation of such wastes, such as industrial plants or municipalities, and are then removed to a pre-prepared disposal site. At the disposal site, a liquid impermeable supporting base is provided, and is preferably surrounded by a peripheral dike. The supporting base may be a natural earth material which is substantially water impermeable, such as clay underlain by shale. The impermeable base may also be artificially constructed where the stratigraphy of the earth does not lend itself to use of natural materials. In a preferred embodiment of the invention the area occupied by the base is surrounded by a confining dike which may be of earthen or other suitable construction. Superimposed on the impermeable supporting base is a geometrically indexing support structure. A geometrically indexing support structure includes a plurality of selectively arrayed surfaces which are collectively positioned to receive and cradle a plurality of the waste containers of the type described. The geometrically indexing support structure may, for example, be reinforced concrete having a lower surface flatly abutting the impermeable supporting base, and having an upper surface which has a plurality of intersecting surfaces arrayed to receive, in flatly abutting contact, a plurality of the faces of the waste containers in use. Thus, if a rhombic dodecahedron is the container form employed, such container will have twelve identically shaped faces, each in the geometric form of a rhombus, and when each such container is rested upon the geometrically indexing support structure constructed in accordance with the present invention, three of these faces will contact three identically shaped rhombic faces in the concrete support structure.

A plurality of such containers can be stacked upon the upper side of the geometrically indexing support structure, and can be extended both horizontally and vertically to construct a generally pyramidally shaped structure extending to a substantial vertical height. The waste containers, because they have been selected to interfit without voids or spaces therebetween as they are faced contiguously to each other in horizontal and vertical extension, collectively form, in essence, a solid structure which can be extended to great heights, and is characterized by very substantial structural strength. As will be hereinafter explained, the particular waste container forms which have been chosen and are used in the present invention also are of substantial value in limiting the emanation of radiation from radioactive waste contained within containers which are deposited, according to the method of the invention, at a confined, central location within the stacked waste containers at the waste disposal site.

The system of the invention further includes a ramp or lifting apparatus adjacent the geometrically indexing support structure for use in vertically tiering the described containers. In a preferred embodiment of the invention, the system further includes at least one waste-utilizing plant adjacent the peripheral dike. Such plant may be within the dike or, in a more preferred construction of the system, is located outside the dike. Such waste-utilizing plant is often constructed at a relatively later time during the use of the system, and will utilize one or more of the industrial or municipal wastes contained within the tiered containers as the raw material or charge stock for manufacturing one or more useful products.

In order to maintain an accessible record for rapid future location of one or more selected specific containers containing a particular waste material for access by one or more industrial plants adjacent the site, a continuing registration or indexing subsystem is utilized to record the precise location within the tiered containers at which a particular waste material container and its contents are located.

In the use of the system, as containers are brought to, and stacked one upon the other, at the waste disposal site, containers which contain radioactive waste materials are preferably located at a central location within the stack, and are surrounded by other waste containers which contain nonradioactive waste materials.

An important object of the present invention is to provide a waste disposal system which safely stores a wide variety of industrial and municipal wastes at a disposal site of relatively small area. The wastes are retained in high-strength confining containers which are placed at the disposal site in a logical geometrical array which gives strength to the stacked containers, shielding to radioactive wastes located in some of the containers, and access to various of the wastes at such time as they become useful in present or future industrial processes.

An additional object of the present invention is to provide a system of waste disposal which is ecologically innocuous, easily used, and has the merit of preserving such wastes against contamination, dilution or deterioration until such time as a useful purpose may be developed for such wastes, enabling them to be converted to useful end products.

Another object of the invention is to provide a system for disposing of industrial wastes which can be economically installed and used by relatively small industrial facilities generating waste materials and which requires no exceptional know-how to technical expertise to employ in the disposition of such wastes.

Additional object and advantages of the invention will become apparent as the following detailed description of the invention is read in conjunction with the accompanying drawings which illustrate a preferred embodiment of the invention.

DETAILED DESCRIPTION OF A PREFERRED EMBODIMENT OF THE INVENTION

Figure 1:
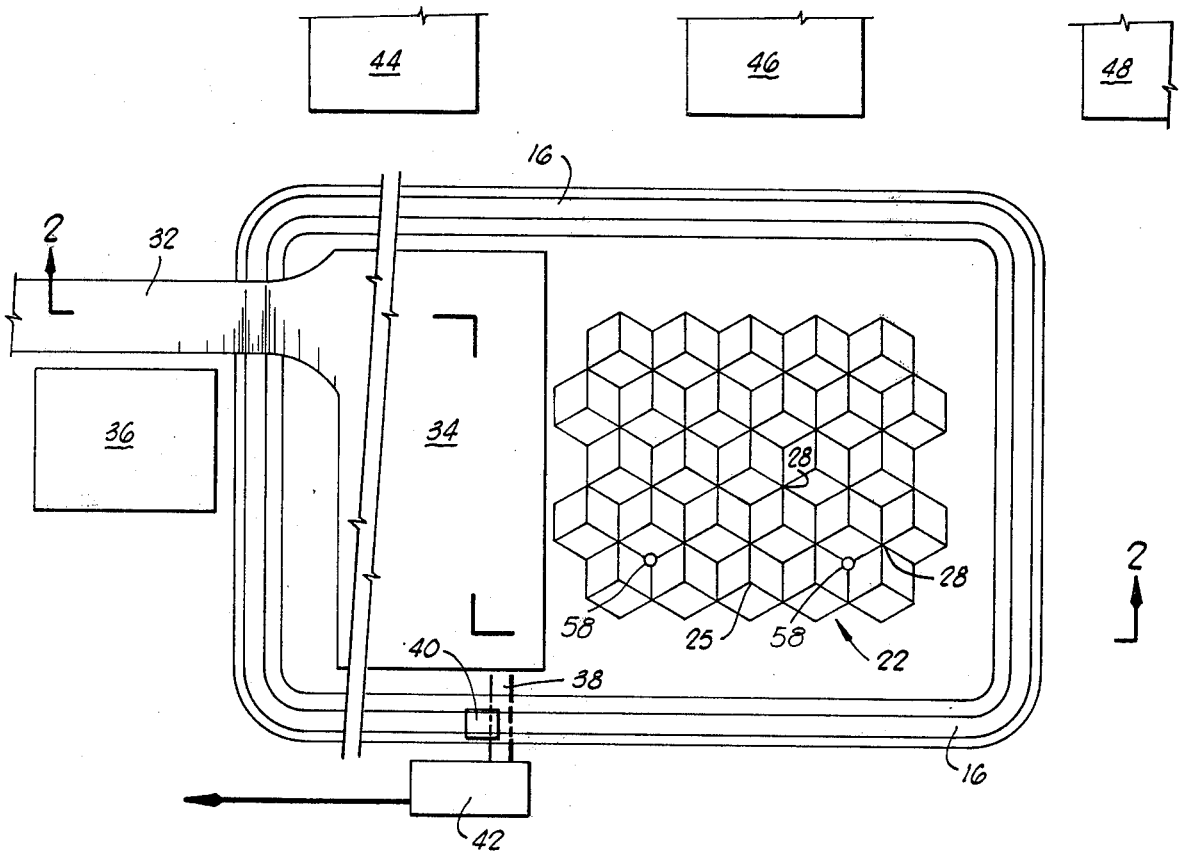
FIG. 1 is a plan view showing a waste disposal site forming a part of the system of the present invention, and illustrating the site as it appears to the time that waste containers forming a further part of the system of the invention have been placed at the waste disposal site.
Figure 2:
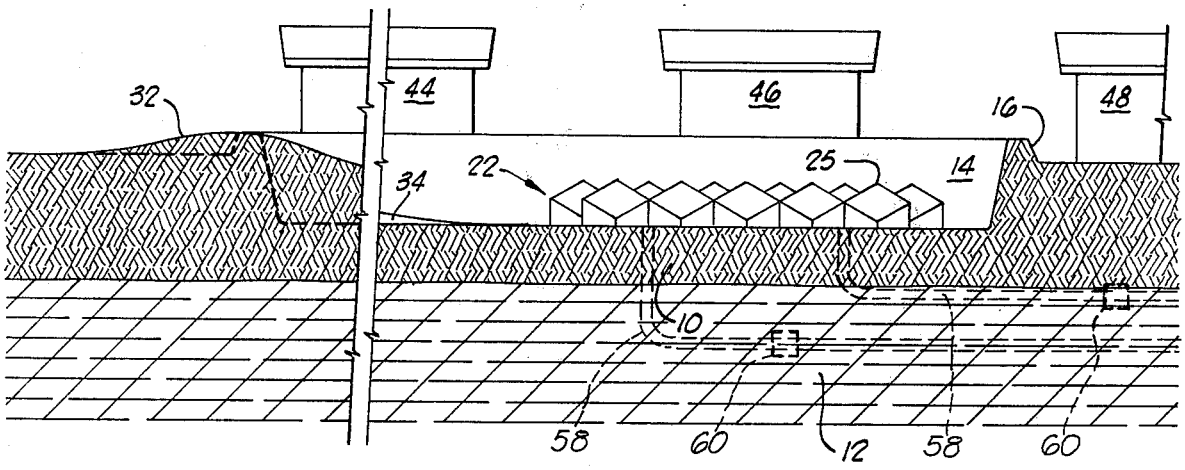
FIG. 2 is a sectional view taken along line 2—2 of FIG. 1.

In FIGS. 1 and 2 of the drawings, a preferred embodiment of a waste disposal site forming a part of the system of the present invention, and constructed in accordance with the principles of the invention, is illustrated. The waste disposal site may vary in size from approximately one-half to many acres, depending upon the particular amount of waste accommodation which is required. It should be noted, however, and will become more clearly apparent from the following description, that the manner in which the waste is located at the disposal site enables hugh volumes of waste to be accommodated upon a relatively small ground area.

Whatever may be the size of the disposal site, the general manner in which it is constructed is substantially the same. Thus, an impermeable supporting base must be provided, and in the illustrated embodiment of the invention, this is constituted by a layer of impervious clay 10 underlain by several strata of shale 12. In the illustrated embodiment, the waste disposal site or facility is in the form of a shallow pit 14 which has been excavated in the earth (but not through the impervious clay layer), and such pit is shown as surrounded by an earthen dike 16. Such dike 16 is not essential to the employment of the most basic principles of the present invention, but is a desirable adjunct to such principles, and adds to the safety of the entire system in contributing redundancy in confining and safely retaining wastes which are stored in a manner more specifically hereinafter described.

It should here be noted that various types of impermeable base or foundation constructions can be used in accordance with the present invention. The principal characteristic which must inherent in any such structure, however, is its impermeability to liquids, whether neutral or acidic or basic or otherwise corrosive. Given sufficient strength in the underlying bedrock or shale strata, impervious clay is excellent for the purpose described. Pretreated and reinforced concrete can also be employed.

Generally centrally within the excavation 14 and within the dike 16 is a geometrically indexing support structure designated generally by reference numeral 22. In the illustrated embodiment, the geometrically indexing support structure 22 is constructed of concrete and has a sufficient base structure to assure stability and support by the earth therebelow. The geometric form of the upper surface of the geometrically indexing support structure 22 is quite important to the practice of the present invention. In general, this upper surface must be complementary in shape and geometric configuration to a series of horizontally aligned waste containers having one of the specific and selected geometric configurations of the type hereinafter described.

As shown in FIG. 1, in the embodiment illustrated, the geometrically indexing support structure presents a multiplicity of upwardly facing intersecting planar surfaces, with each of these surfaces being a rhombus. The upper side of the geometrically indexing support structure 22 is configured so that sets of three of the rhombic faces intersect at a common corner 23, which is, for each array of three rhombi, the lowest point in each of the three rhombically configured planes. At other points spaced from the corners 23 and located on the upper side of the geometrically indexing support structure, three of the rhombi intersect in a common elevated corner point 25, and each such point is the highest point in the respective three rhombically configured planes which commonly contain such point. At points which are intermediate in height between the highest corners 25 and lowest corners 23, heretofore referenced, six of the rhombically configured planes intersect in a common corner or point 28.

Figure 4:
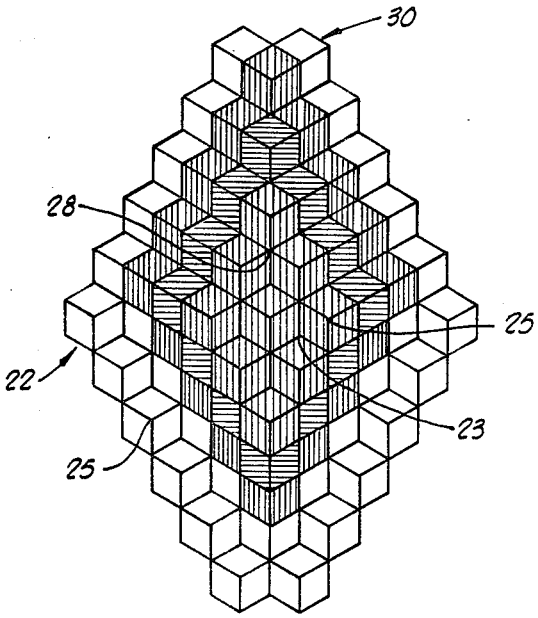
FIG. 4 is a plan view of a stack of waste containers which have been arrayed and stacked in accordance with the method of waste disposal of the present invention.
Figure 5:
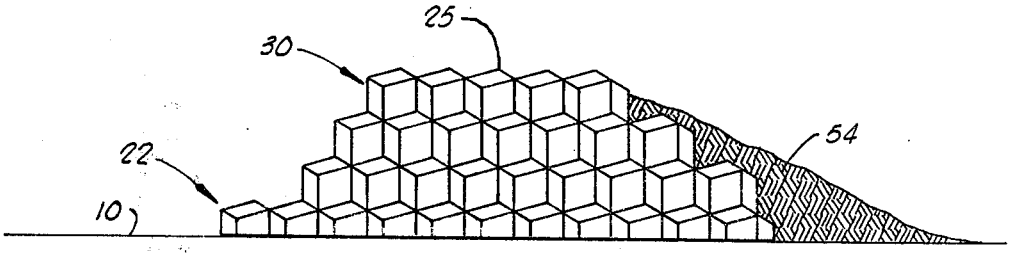
FIG. 5 is a side elevation of stacked waste containers tiered to a height of three containers, and supported upon the geometrically indexing support structure forming a part of the system of the invention.

The described configuration of the upper side of the geometrically indexing support structure 22 assures that the plurality of the preferred rhombic dodecahedron containers can be placed on the geometrically indexed support structure so that no space or gaps are left between the several contacting surfaces of the rhombic dodecahedrons and the geometrically indexing supporting structure. This arrangement is illustrated by the plan view of FIG. 4, and in the side elevation view of FIG. 5.

Figure 3:
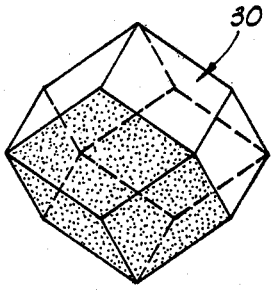
FIG. 3 is a perspective view of a preferred form of waste container useful in the practice of the present invention, such form of container constituting a rhombic dodecahedron.

One of the rhombic dodecahedron containers 30 is illustrated in FIG. 3 of the drawings, and it will here be perceived that the external surface of this container is made up of a plurality of contiguous surfaces, each in the form of a rhombus. The shaded areas show three rhombic surfaces which will flately abut three corresponding surfaces of the geometrically indexing support structure 22 when the container 30 is rested upon and interfitted with the upper surface of the support structure. It may be pointed out that as the containers 30 of rhombic dodecahedron shape are stacked upon the geometrically indexing support structure 22, the upper side of a group of such containers constituting the first tier or, stated differently, those in horizontal alignment, replicate the configuration of the upper side of the geometrically indexing support structure 22, and can be built upon by succeeding tiers of such containers in the same fashion. The described arrangement imparts great stability and structural strength to the collective group of waste containers stacked in this fashion at the waste disposal site, even though such containers are stacked to a great height. Moreover, no spaces or voids exist between a container 30 located internally in the stack and all those containers which surround it.

The construction of the waste containers 30, and particularly, the rhombic dodecahedron container constituting a preferred container form for use in the invention, will be discussed in greater detail hereinafter. It should be noted at this point, however, that several other shapes of containers can be utilized, including the truncated octahedron illustrated in FIg. 7 of the drawings. The principal required characteristic of the geometry of the particular waste container used is that the capability exists for stacking or tiering such containers, while extending them in a horizontal array, so that contiguous sides of the containers abut each other flatly, and that no voids or spaces exist between containers except as the upper sides thereof may be exposed by reason of no placement of superadjacent containers thereagainst.

For the purpose of providing access to the waste disposal site, a roadway 32 is constructed to pass over the dike 16 and into a container unloading area 34. The container unloading area within the pit 14 can be of the illustrated rectangular configuration, or can extend completely around the geometrically indexing support structure 22. At a location adjacent the roadway 32, a waste pretreatment facility 36 is located. The waste pretreatment facility 36 includes a suitable housing in which various chemicals and chemical dispensation means may be located, and operated by a suitably trained operator. The purpose of this facility is to permit certain types of wastes being brought to the waste disposal site to be pretreated, should this be desirable, to neutralize corrosive materials located within the containers, or perhaps to initiate certain chemical or biological reactions which either render the waste innocuous, or convert it to a more useful form. In many instances, of course, no such pretreatment will be desired or necessary, and the pretreatment facility 36 will then not be used, nor will the waste containers 30 be opened for any purpose prior to stacking them in the heretofore described tiered arrangement upon the geometrically indexing support structure 22.

At one side of the waste facility, a suitable spillway 38 is provided, and associated with the spillway is an alarm system 40 and a pumping subassembly 42.

Disposed outside the pit 14 and alongside the dike 16 at one side thereof are a plurality of industrial plants 44, 46 and 48. The number of these industrial plants may vary, and indeed, at the time that the use of the waste facility is first begun, none of such plants may be located adjacent the facility in the manner described. The purpose of these industrial plants will be hereinafter described.

Figure 6:
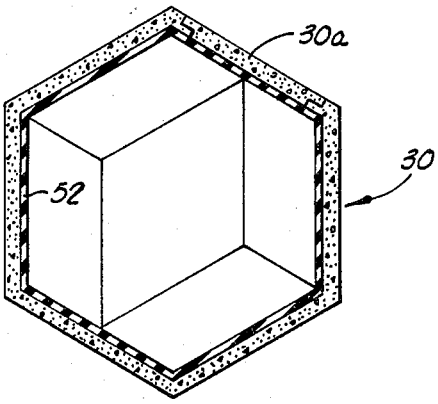
FIG. 6 is a sectional view through one of the waste containers which has been lined with a lining material which is selected for resistance to corrosion and chemical attacks by the particular type of waste to be placed therein, such container being of the rhombic dodecahedron type.

One typical construction of one of the rhombic dodecahedron waste containers 30 is illustrated in FIG. 6 of the drawings. It will be here noted, in viewing the container in section, that one of the rhombic faces of the container 30 is constructed as a removable lid 30*a* which can be removed to provide access to the inside of the container. Any suitable means of removing the lid 30*a* can be utilized, provided that no protruding handle or other structure projecting out of the planar rhombic face is employed. The particular container 30 illustrated in FIG. 6 is internally lined with a rubber or similar elastomeric lining. Such lining is selected to provide maximum resistance to the particular type of waste material which is to be located in the container. Various other types of lining can also be employed beneficially, depending upon the type of waste which is to be placed in the waste container. Thus, where waste material which is radioactive is to be placed in the container, lead shielding may be used to line the container, and the container itself may be made of concrete. Various types of plastic or synthetic resin linings which are particularly resistant to chemical attack by various types of acids or bases can also be employed. With many types of wastes, no lining at all will be needed.

The main external walls of the container 30 can likewise be constructed of various materials. These walls can be made of steel, or may be made of various forms of strengthened concrete. In some instances, they can also be molded of a plastic material. The principal requirements of the container main external walls is that they be structurally strong, and have a relatively long service life while subjected over that period to contact (unless lined) with the particular waste material contained therein, as well as being exposed often to inclement and severe weather.

In the practice of the waste disposal methods of the invention, and using the described waste disposal system, various industries or municipalities which generate significant quantities of liquid, solid particulate or slurry-type wastes maintain at the points or sites at which such wastes are generated, one or more of the waste containers 30. The containers 30 can vary greatly in size, but will generally range from 100-gallon capacity up to 5,000-gallon capacity. At the point of waste generation, the containers 30 are rested upon one of the rhombically shaped surfaces so that the lid 30*a* faces generally upwardly and, when removed, provides easy access to the interior of the container.

With the lid 30*a* removed, and assuming that each container 30 in use has been lined to accommodate the type of waste which is generated at a particular site, the day-to-day operation of the plant generates waste which can be intermittently discharged into one or a plurality of the open containers. With some types of wastes, it may be desirable, instead of providing a lid 30*a* of the type described, to place a pipe through a face of the container to the interior thereof, and provide a seal around the opening through which the pipe passes to the interior of the container. The waste material can then be discharged into the container without exposing plant personnel in charge of the waste disposal operation to the discharging waste.

After a particular waste generating facility has filled one or more of the containers 30, these are loaded on suitable vehicles and trucked to the waste disposal site. At the waste disposal site, the vehicle may stop at the pretreatment station 36 in order to permit pretreatment of the waste carried in the containers 30, if this should be desirable prior to offloading. It may, for example, be desirable to add a caustic solution to highly acidic wastes in order to neutralize them. In the case of other wastes, pretreatment can result in a chemical or microbiological conversion of the wastes to a material useful as a charge stock or intermediate in certain industrial processes. In the case of other wastes, no pretreatment may be required.

After entering the waste disposal site by crossing over the dike 16, the waste containers 30 are unloaded from the transporting vehicles in any suitable fashion. Cranes or lifting devices may be provided alongside the indexing support structure 22. It is also contemplated that a suitable ramp, such as that shown at 54 in FIG. 5, may be built up along one side of the pyramid of waste containers as these are vertically tiered and stacked over a period of time. Such ramp 54 will permit the transporting vehicles to drive up to the locus of the top tier of containers and, if suitable unloading mechanism is provided on the transporting vehicles, to there unload the waste containers, and to position them in the stacked array heretofore described. The stacking procedure employed assures, of course, that there is no space or voids left between contiguous containers.

It will be noted in referring to FIG. 3 that the particular configuration of the rhombic dodecahedron thereshown facilitates engaging the container along its under or lower side by means of a grapple, and this means can be employed in placing the container in a proper position within the pyramid rising atop the geometrically indexing support structure 22. Other means may be employed with advantage in some situations, however, such as the use of a magnetic lift in the case of steel containers, a suction device placed flatly against one of the rhombic faces and used to lift the container or the provision of an eye imbedded and countersunk in one of the faces of the container or at one of the points or corners thereon to enable the container to be lifted by a suitable cable and hook structure and then lowered into the proper position where the lower faces of the container mate precisely with the exposed upwardly oriented faces of containers upon which it is to rest in the container pyramid.

Generally, the waste disposal site will be sufficiently large, and the geometrically indexing support structure 22 will cover sufficient area, that waste containers 30 from many different industry or municipality sources can be brought and placed in the pyramid. As waste containers are brought to the waste disposal site, they are placed upon the geometrically indexing support structure 22 in a known order and array. An indexing and registration shown is maintained whereby the location of any particular container (and its contents) within the entire tiered grouping of containers is known at all times. The purpose of this indexing and registration is to permit retrieval of a particular waste container and its contents for subsequent utilization at one or more industrial plants of the type schematically illustrated at 44, 46 and 48 in FIG. 1 of the drawings. Thus, although a particular waste material may have little or no utility in the month or year in which it is located at the waste disposal site and stacked in the pyramid of containers, its contents may become quite valuable at some future time as a charge stock or intermediate material in a manufacturing facility making useful products of the future. For example, some organic type waste materials are now believed to pose possible valuable sources of methane as naturally occurring fossil fuels are depleted. At such time as the possibility of utilization of some of the wastes disposed of in this fashion becomes more realistic and feasible, the waste disposal facility can be operated so that container tiering and stacking is carried out during certain hours of the day, and retrieval of containers holding useful waste material can be carried out at other hours. If containers are removed from the pyramid for utilization in the industrial plants 44-48, re-indexing and re-registration may become necessary in view of the dislocation of the particular containers so removed, but with modern computer technology, such re-indexing and re-registration does not present a difficult problem.

It should also be pointed out that as the waste containers 30 are stacked upon the geometrically indexing support structure 22, and the height of the tiered containers to rise, selective placement of the containers is carried out to provide the most suitable storage of certain types of wastes. Thus, for example, containers which carry radioactive wastes are placed in an interior position such that they are surrounded by numerous other containers. Preferably, containers holding such wastes are surrounded by containers of concrete construction, thus presenting paths of relatively low transmissibility of radioactive emanations through the tiered containers to the outside of the stack. In this regard, it is important to note that there are no straight lines of juncture between the faces of contiguous containers, so that no linear path exists along container interfaces from the interior of the stack to the outer side thereof. Stated differently, the contiguous faces on each container extend at an angle of more than 90° to each other, and therefore there is no continuous unbroken interfacial plane which extends between containers from inside the pyramid to the outer side thereof. This is important in the storage of radioactive wastes within the interior of the pyramid. This is because the radioactive emanations from the waste material are propagated most effectively along linear paths of travel, and the particular geometry of the containers and their method of contiguous stacking obviates any such straight line transmission paths from the interior to the outer side of the stack.

Figure 7:
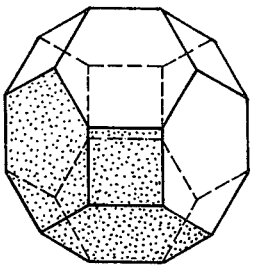
FIG. 7 is a perspective view of yet another type of waste container which can be used in the system of the invention, such container being of truncated octahedron form.

The use of one of the two preferred types of container forms shown in the drawings, i.e., the rhombic dodecahedron container 30, shown in FIG. 3, or the truncated octahedron shown in FIG. 7, assures that relatively large volumetric capacities are characteristic of the containers, and also greatly improves the strength which characterizes the several containers. This feature also lends great structural strength to the pyramid of containers ultimately formed and this assures stability against high winds and, to some extent, against minor earthquakes. Because of this geometry and the internesting face-to-face array of the numerous waste containers placed in the pyramid, the pyramid can be elevated to a relatively great height, given a sufficiently broad base upon which to build. Moreover, these geometries afford a self-aligning and self-seating capability to the stacking operation which would not be characteristic of cubic containers.

In the event there should be some structural damage to the containers 30 resulting from a severe earthquake, or perhaps lightning bolt impingement on the pyramid, the dike 16 affords a redundant safety factor and functions to contain leaking waste materials which may be discharged from a ruptured or damaged container. In the event torrential rains may occur, particularly at a time of structural damage to the tiered containers, the dike 16 includes a spillway 18 through which the excess water may be channeled and the flow of water and waste through the spillway then sensed at the sensing station 40. Pumping mechanism at the pumping subassembly 42 can then be energized to carry off the overflow from the pit 14 to a standby disposal site in the event of the occurrence of the described extreme conditions.

In a preferred embodiment of the invention, it is further preferred to provide discharge pipes 58 which open at one or more of the low points 23 in the upper side of the supporting structure 22, and project downwardly and then horizontally therefrom, as shown in FIGS. 1 and 2. These pipes 58 function to collect any relatively slow liquid leakage from any of the waste containers, and to convey such liquid to sensing and analyzing units 60 where its chemical composition can be determined. This information can be used in conjunction with information derived from the indexing and registration system hereinbefore described to locate within the stack, the container which is leaking.

Although preferred embodiments of the invention have been herein described in order to afford a clear understanding of the basic principles which underlie the invention, various changes and innovations can be made in the illustrated preferred embodiments without departure from these basic principles. Changes and innovations of this type are therefore deemed to be circumscribed by the spirit and scope of the invention as defined by the following claims, or reasonable equivalents thereof.

What is claimed is:

1. A system for disposing of wastes comprising:

a disposal site including:

a base which is substantially liquid impermeable; and a geometrically indexing support structure on said base and including an upper side geometrically configured to contact and support a plurality of contiguously placed waste containers of identical shape, said upper side having a configuration complementary and identical to the collective downwardly facing surfaces of a multiplicity of said containers when arrayed in horizontal alignment and in abutting contact with each other so that no lateral spaces or voids exist between said containers; and a plurality of identically shaped polyhedron waste containers stacked on said geometrically indexing support structure in an array to extend in horizontal alignment, in vertical tiers of horizontally aligned containers with said containers collectively occupying the minimum possible volume permitted by their solid geometry, the geometric shape of each of said containers being such that each of said containers has at least eight identical faces and each and every face of each container can be flatly abutted against an identically shaped face on a different container, and with all such abutting faces concurrently contacted during stacking of the containers above that first tier of horizontally aligned containers supported on the upper side of said support structure.

2. A system for disposing of wastes as described in claim 1 and further characterized as including a retaining dike surrounding said base and indexing support structure.

3. A system for disposing of wastes as described in claim 2 and further characterized as including at least one industrial plant outside said dike adjacent said disposal site for utilizing wastes contained in some of said waste containers.

4. A system for disposing of wastes as described in claim 2 and further characterized as including:

an access road crossing said dike to a container off-loading location adjacent said geometrically indexing support structure; and means adjacent said access road immediately outside said dike for treating wastes in said waste containers.

5. A system for disposing of wastes as described in claim 1 and further characterized as including at least one industrial plant adjacent said disposal site for utilizing waste contained in some of said waste containers.

6. A system for disposing of wastes as described in claim 1 and further characterized as including means adjacent said disposal site for treating wastes in said waste containers.

7. A system for disposing of wastes as described in claim 1 wherein each of said containers is externally configured as a rhombic dodecahedron.

8. A system for disposing of wastes as described in claim 1 wherein each of said containers is externally configured as a truncated octahedron.

9. A system for disposing of wastes as described in claim 1 wherein said base is a layer of substantially liquid impermeable clay in the earth.

10. A system for disposing of wastes as described in claim 1 wherein each of said containers is constructed of concrete, having a waste-resistent internal lining.

11. A system for disposing of wastes as described in claim 10 wherein each of said containers is configured as a rhombic dodecahedron.

12. A system for disposing of wastes as described in claim 11 wherein said geometrically indexing support structure is constructed of concrete.

13. A system for disposing of wastes as described in claim 12 and further characterized as including at least one industrial plant adjacent said disposal site for utilizing waste contained in some of said waste containers.

14. A system for disposing of wastes as described in claim 13 and further characterized as including means adjacent said disposal site for treating wastes in said waste containers.

15. A system for disposing of wastes as described in claim 12 wherein said base is a layer of substantially liquid impermeable clay.

16. A system for disposing of wastes as described in claim 1 wherein said geometrically indexing support structure is constructed of concrete.

17. A system for disposing of wastes as described in claim 1 wherein at least one of said containers in the interior of said stack and surrounded on all of its sides by others of said containers is further characterized in having a hollow interior lined with a material of relatively low nuclear radiation transmissibility.

18. A system for preserving potentially useful industrial and municipal wastes comprising:

a plurality identically shaped polyhedron of waste containers, having at least eight indentical faces, arranged to permit each such container to be surrounded by others of the containers with no void space therebetween by reason of every area on the outer peripheral surface of the surrounded container being in abutting contact with an equivalent area on at least one of the other containers;

supporting means supporting said plurality of containers on the earth, said supporting means comprising:

a substantially liquid impermeable base; and a container support structure including a lower side supported upon and above the base and an upper side which is geometrically configured to receive and support said containers in flatly abutting contact with one or more surfaces on said upper side when said containers are arranged in horizontal alignment with each other on said upper side, said horizontally aligned containers collectively having a downwardly facing group of surfaces which are geometrically identical in their totality to an upwardly facing group of faces on said containers, said containers being positioned contiguously to each other on said support structure with no space between the containers and the support structure; and means for confining, in an area over said liquid impermeable base, any liquids which leak from said containers.

19. A system for preserving potentially useful industrial and municipal wastes as described in claim 18 wherein each of said waste containers is a rhombic dodecahedron in configuration.

20. A system for preserving potentially useful industrial and municipal wastes as described in claim 18 wherein each of said waste containers is a truncated octahedron in configuration.

21. A system for preserving potentially useful industrial and municipal wastes as described in claim 18 wherein said container support structure is constructed of reinforced concrete.

22. A system for preserving potentially useful industrial and municipal wastes as described in claim 18 and further characterized as including linings lining the hollow interiors of some of said containers to facilitate the containment of corrosive wastes therein.

23. A system for preserving potentially useful industrial and municipal wastes as described in claim 18 wherein said confining means comprises a dike.

24. A system for preserving potentially useful industrial and municipal wastes as described in claim 18 wherein said containers are each constructed of concrete.

25. A system for preserving potentially useful industrial and municipal wastes as described in claim 18 wherein the upper side of said container support structure is characterized in having a plurality of spaced depressions therein, each of said depressions being defined by a plurality of contiguous surfaces of said container support structure; and wherein one of said waste containers fits into and fills each of said depressions.

26. A system for preserving potentially useful industrial and municipal wastes as described in claim 25 wherein each of said containers is a rhombic dodecahedron in configuration.

27. A system for preserving potentially useful industrial and municipal wastes as described in claim 26 wherein said containers are each constructed of concrete.

28. A system for preserving potentially useful industrial and municipal wastes as described in claim 27 wherein said confining means comprises a dike surrounding said supporting means.

29. A system for preserving potentially useful industrial and municipal wastes as described in claim 28 and further characterized as including means adjacent said supporting means for treating wastes carried within said containers prior to the time said containers are placed upon said supporting means.

30. A system for preserving potentially useful industrial and municipal wastes as described in claim 18 and further characterized as including vehicular access means adjacent said container support structure facilitating vehicular transport of additional waste containers to a location at the upper side of the topmost containers supported on said container support structure.

31. A system for preserving potentially useful industrial and municipal wastes as described in claim 18 wherein said liquid impermeable base is a layer of liquid impermeable clay.

32. A method of storing and utilizing waste matter in an environmentally safe, space-conservative manner comprising:

placing the waste matter in a plurality of stackable, identically shaped, polyhedron containers, each having at least eight identical sides and configured to register with contiguously positioned identical containers therearound to thereby form a geometric solid containing solely voids constituted by the waste matter-containing hollow interior of the several containers;

selectively stacking the waste matter-containing containers on a supporting structure in vertical tiers, with each tier containing a plurality of horizontally aligned containers in contiguous abutting relationship, and with no space between containers within the stack, said supporting structure including as upper side geometrically configured to contact and support a plurality of said contiguously placed waste containers of identical shape, said upper side having a configuration complementary and identical to the collective downwardly facing surfaces of a multiplicity of said containers when arrayed in horizontal alignment and in abutting contact with each other so that no lateral spaces or voids exist between said containers; and indexing and registering the location of each container in the stack to facilitate future location and retrieval thereof to gain access to the waste material stored therein.

33. A method of storing and utilizing waste matter in an environmentally safe, space-conservative manner as described in claim 32 and further characterized as including the further step of confining said supporting structure and containers stacked thereon within a liquid-holding retaining structure to restrict horizontal flow of liquid leakage from any of said containers.

34. A method of storing and utilizing waste matter in an environmentally safe, space-conservative manner as defined in claim 33 wherein said containers are externally shaped and are selectively stacked so each exterior surface of each container is in flatly abutting registering contact with a mating exterior surface on another container, and wherein each container surface extends at an angle larger than 90° to each of the contiguous surfaces on the same container whereby no single contiguous interfacial plane between abutting container surfaces extends all the way from one side of the stack to the other, thus impeding liquid and radioactive emanation transmission through the stack of containers along paths of travel between containers.

35. A method of storing and utilizing waste matter in an environmentally safe, space-conservative manner as defined in claim 34 and further characterized as including the step, carried out before selective stacking of the containers, of treating the waste in one or more of the containers to desirably alter the properties of the waste matter contained therein.

36. A method of storing and utilizing waste matter in an environmentally safe, space-conservative manner as described in claim 32 wherein the waste matter placed in some of said containers is radioactive, and said containers containing radioactive material are placed interiorly within the stack of containers on said supporting structure with each such interiorly placed container completely surrounded by other containers all in contact therewith.

37. A method of storing and utilizing waste matter in an environmentally safe, space-conservative manner as described in claim 32 wherein said containers are externally shaped and are selectively stacked so each exterior surface of each container is in flatly abutting registering contact with a mating exterior surface on another container, and wherein each container surface extends at an angle larger than 90° to each of the contiguous surfaces on the same container whereby no single continuous interfacial plane between abutting container surfaces extends all the way from one side of the stack to the other thus impeding liquid and radioactive emanation transmission through the stack of containers along paths of travel between containers.

38. A method of storing and utilizing waste matter in an environmentally safe, space-conservative manner as defined in claim 32 and further characterized as including the step, carried out before selective stacking of the containers, of treating the waste in one or more of the containers to desirably alter the properties of the waste matter contained therein.

39. A method of storing material in a stable, structurally strong, multi-compartmented structure comprising:

forming an indexing support structure extending substantially horizontally on the ground and having a generally upwardly facing upper side formed by a plurality of contiguous, identical polygonal surfaces all lying in different planes, a part of said surfaces converging to collectively form a series of spaced, identical depressions in said upper side, and a part of said surfaces collectively having a series of points in common, which points are spaced and are located in a common horizontal plane elevated above the remaining points in said polygonal surfaces, whereby containers of selected polyhedral configuration each having external surfaces which will mate with the surfaces in said upper side defining each of said depressions can be interfitted into said depressions and retained therein against displacement by the geometry of said upper surface;

forming a first plurality of hollow storage containers of said polyhedral configuration, each having first external surfaces sized and configured to mate and register with the depression-forming surfaces of said upper side forming one such depression, and collectively having additional external surfaces configured and gemoetrically located to geometrically replicate a substantial portion of the upper side of said support structure when said plurality of hollow storage containers is rested upon said support structure with such mating and registration effected;

placing material to be stored in said containers;

indexing the material-containing containers to the support structure by resting them on the upper side thereof with said first external surfaces mated and in registry with said depression-forming surfaces;

forming a multiplicity of additional hollow storage containers sized and geometrically configured identically to said first plurality of storage containers;

placing material to be stored in said additional storage containers; then stacking said additional containers on said first plurality of containers and on each other in the same way said first plurality of containers is indexed to, and rested upon, the support structure to thereby form a generally frusto-pyramidal stack of containers in which each container located internally in the stack has all of its external surface area in contact with the external surfaces of surrounding containers without the existence of any space between said internally located container and the surrounding containers.

40. A method of storing material in a stable, structurally strong, multi-compartmented structure as defined in claim 39 and further characterized as including the step of lining some of said containers with material resistant to attach by material stored therein.

41. A method of storing material in a stable, structurally strong, multi-compartmented structure as defined in claim 40 wherein said indexing and stacking steps are accomplished by attaching a suction device to the outer side of the containers to facilitate lifting and lowering the containers.

42. A method of storing material in a stable, structurally strong, multi-compartmented structure as defined in claim 40 and further characterized as including the additional step of indexing and registering the location of each container in the stack to facilitate selective furture retrieval of a particular stored material.

43. A method of storing material in a stable, structurally strong, multi-compartmented structure as defined in claim 40 and further characterized as including the step of surrounding said frusto-pyramidal stack of containers with a liquid flow impeding means to accommodate accidental failure of structural integrity of one or more of said containers.

44. A supporting assembly for supporting a plurality of identically shaped, internested rigid containers stacked in contiguous relation and each having a polyhedric configurations and having at least eight sides, said supporting structure comprising:

a rigid base; and a geometrically indexing container support structure including a lower side above and supported upon the base and a multi-surfaced upper side geometrically configured with upwardly facing polygonal surfaces to receive and support a plurality of contiguously placed waste containers of identical shape, each having a plurality of surfaces in flatly abutting contact with a plurality of said upwardly facing surfaces on said upper side, said upper side polygonal surfaces all lying in different planes, a part of said upper side polygonal surfaces converging to collectively form a series of spaced depressions in said upper side, and a plurality of groups of said upper side polygonal surfaces, each having a series of points in common, which points are spaced and located in a common horizontal plane elevated above the remaining points in the upper side surfaces in each of said groups, whereby containers of a selected polyhedral configuration having external surfaces mateable and registerable with corresponding identically shaped upper side polygonal surfaces can be interfitted into said depressions and retained therein against lateral displacement by the restraining effect of the geometry of said upper side, said upper side geometry being such that polyhedric containers of selected configurations can be supported thereon to contact all said upper side polygonal surfaces and, in doing so, replicate the exact geometry of said upper side by the arrangement and location of the external surfaces of the polyhedric containers not in contact with said upper side, thereby facilitating augmentation of the height of the stack of containers supported over said support structure by repeating the described stacking process using each tier of containers as another geometrically indexing support structure.

45. A system for storing waste materials of various types and for quickly identifying a particular waste material leaked from within said system comprising:

a supporting assembly for supporting a plurality of identically shaped rigid polyhedric waste containers each having at least eight sides, said supporting assembly comprising:

a rigid base; and a geometrically indexing container support structure including a lower side supporting upon and above the base, and an upper side geometrically configured to receive and support a plurality of contiguously placed waste containers of identical shape, with the container each having a plurality of surfaces in flatly abutting contact with a plurality of upwardly facing surfaces on said upper side, said upper side defining a plurality of polygonal surfaces all lying in different planes, a part of said upper side surfaces converging to collectively form a series of spaced depressions in said upper side, and a plurality of said groups of said upper side surfaces having a series of points in common, which points are spaced and located in a common horizontal plane elevated above the remaining points in the upper side surfaces in each of said groups, whereby containers of a selected polyhedral configuration having external surfaces matable and registerable with corresponding identically shaped upper side surfaces can be interfitted into said depressions and retained therein against lateral displacement by the restraining effect of the geometry of said upper side, said upper side geometry being such that polyhedric containers of selected shapes can be supported thereon to contact all of said upper side surfaces and, in doing so, replicate the exact geometry of said upper side by the arrangement and location of external surfaces of the polyhedric containers not in contact with said upper side, thereby facilitating augmentation of the height of the stack of containers supported over said support structure by repeating the described stacking process using each tier of containers as another geometrically indexing support structure; and a plurality of stacked polyhedron waste containers stacked upon and supported by said support structure and each having at least eight polygonal exterior faces, said faces configured and arranged to permit each such container to be surrounded by others of the containers with no void space therebetween by reason of every area on the outer peripheral surface of the surrounded container being in abutting contact with an equivalent area on at least one of the other containers, and wherein each container face extends at an angle larger than 90° to each of the contiguous faces on the same container whereby no single continuous interfacial plane between abutting container surfaces extends all the way from one side of the stack to the other, and the stacked containers thus impede liquid and radioactive emanation transmission through the stack of containers along paths of travel between containers, said stacked containers including:

a first tier of containers, each container in said first tier having first external faces mating and registering with the depression-forming surfaces of said upper side forming one such depression, and said first tier containers collectively having additional external faces geometrically configured and located to geometrically replicate a substantial portion of the upper side of said support structure; and additional tiers of containers resting upon and stacked vertically above said first tier of containers in the same way said first tier is stacked upon said support structure whereby the first tier and additional tiers form a generally frusto-pyramidal stack of containers in which each container located internally in the stack has all of its external surface area in contact with external surfaces of surrounding containers without the existence of any space between the internally located container and the surrounding containers;

a collection pipe connected to a plurality of said depressions in the upper side of said container support structure for separately collecting liquid which has leaked from certain of said containers downwardly inlto each of said plurality depressions; and a sensing and analyzing unit connected to each of said collection pipes for determining the identity of the collected leaked liquid, thereby facilitating, in conjunction with the geometry of the containers and stack of containers, the location and identification of the container from which the leakage originated.

* * * * *

UNITED STATES PATENT AND TRADEMARK OFFICE

CERTIFICATE OF CORRECTION

PATENT NO. : 4,415,459

DATED : November 15, 1983

INVENTOR(S) : Moody L. Coffman and Lawrence R. Bradshaw, Jr.

It is certified that error appears in the above-identified patent and that said Letters Patent are hereby corrected as shown below:

Col. 2, line 22, change "use" to --us--. Col. 4, line 2, "to" 1st. occurrence should read --or--. Column 5, line 8, change "inherent" to --inhere--. Column 8, line 48, change "shown" to --system--. Column 9, line 13, insert --continues-- before the words "to rise". Column 11, line 57, insert the word --of-- before the word "identically"; Column 11, line 57, delete the word --of-- before the word "waste". Column 15, line 47, change "configurations" to --configuration--. Column 16, line 28, change "supporting" to --supported--; Column 16, line 32, change "container" to --containers--.

Signed and Sealed this

*Twenty-first* Day of *August 1984*

[SEAL]

*Attest:*

GERALD J. MOSSINGHOFF

*Attesting Officer*

*Commissioner of Patents and Trademarks*